US008191518B2

(12) United States Patent
Stein et al.

(10) Patent No.: US 8,191,518 B2
(45) Date of Patent: Jun. 5, 2012

(54) VALVETRAIN CONTROL ARRANGEMENT

(75) Inventors: Uwe Bernhard Pascal Stein, Edinburgh (GB); Niall James Caldwell, Edinburgh (GB); William Hugh Salvin Rampen, Edinburgh (GB)

(73) Assignee: Artemis Intelligent Power Limited, Edinburgh (GB)

( * ) Notice: Subject to any disclaimer, the term of this patent is extended or adjusted under 35 U.S.C. 154(b) by 593 days.

(21) Appl. No.: 11/817,078

(22) PCT Filed: Feb. 27, 2006

(86) PCT No.: PCT/GB2006/000677

§ 371 (c)(1),
(2), (4) Date: Mar. 28, 2008

(87) PCT Pub. No.: WO2006/090174

PCT Pub. Date: Aug. 31, 2006

(65) Prior Publication Data

US 2008/0245322 A1 Oct. 9, 2008

(30) Foreign Application Priority Data

Feb. 26, 2005 (GB) ..... 0504058.9

(51) Int. Cl.
*F01L 9/02* (2006.01)

(52) U.S. Cl. ..... 123/90.12; 123/90.11; 123/90.13; 91/418

(58) Field of Classification Search ..... 123/90.12, 123/90.13, 90.11; 91/418
See application file for complete search history.

(56) References Cited

U.S. PATENT DOCUMENTS

| | | | | |
|---|---|---|---|---|
| 4,206,728 | A | 6/1980 | Trenne | |
| 4,716,862 | A | 1/1988 | Sauro et al. | |
| 4,898,129 | A | 2/1990 | Junghans et al. | |
| 5,190,446 | A * | 3/1993 | Salter et al. | 417/297 |
| 5,537,976 | A * | 7/1996 | Hu | 123/322 |
| 6,173,684 | B1 * | 1/2001 | Buehrle et al. | 123/90.12 |
| 6,308,690 | B1 | 10/2001 | Sturman | |

FOREIGN PATENT DOCUMENTS

| | | |
|---|---|---|
| DE | 35 20 215 | 9/1986 |
| DE | 36 11 476 | 10/1987 |
| EP | 0361927 | 4/1990 |
| GB | 754 998 | 8/1956 |

* cited by examiner

*Primary Examiner* — Ching Chang
(74) *Attorney, Agent, or Firm* — Stephen H. Eland; Dann, Dorfman, Herrell & Skillman

(57) ABSTRACT

A valvetrain control arrangement for an internal combustion engine. A fluid-working machine (1) has working chambers (3) of cyclically varying volume, each connected to a piston actuator (4) which is capable of moving an intake or exhaust valve in the internal combustion engine. The engine crankshaft (2) drives a crankshaft of the fluid-working machine at the same speed as the engine. Each working chamber (3) is linked to a low-pressure manifold (7) by a venting valve (6), the venting valve being normally open but electromagnetically closable by a signal from an electronic sequencing means (8) which operates in timed relationship to the engine crankshaft phase.

19 Claims, 3 Drawing Sheets

VALVETRAIN CONTROL ARRANGEMENT

Priority Applications

This application is a 371 application of International Application No. PCT/GB06/00677 filed Feb. 27, 2006, which claims priority to United Kingdom Patent Application No. 0504058.9 filed Feb. 26, 2005. Each of the foregoing applications is hereby incorporated herein by reference.

BACKGROUND TO THE INVENTION

This invention relates to the hydraulic actuation of intake and exhaust valves in an internal combustion engine. Many camless, i.e. direct valve actuation techniques have been developed, most of which work on a common rail basis, if they are hydraulic or pneumatic, or electro-magnetically if they are not. Other means have been developed to change the phase relationship of conventional camshafts with the crankshaft over the speed range. Solenoid venting valves have been used in conjunction with hydraulic tappets to keep valves closed, thereby disabling cylinders for improved part load efficiency. The approach described here is fundamentally different. Its objectives are the same as the other camless techniques but it aims to achieve them with much reduced parasitic power loss and complexity.

The fluid-working machine described in EP-B-361927 uses cycle-by-cycle mode selection of its positive displacement pumping chambers. We have discovered that an extension of this technique to control the phasing and duration of a cyclic linear fluid actuation, working at the frequency of the input shaft, can be used to open and shut intake and exhaust valves in internal combustion engines.

SUMMARY OF THE INVENTION

The invention provides a valvetrain control arrangement according to the independent claim. Preferred or optional features of the invention are defined in the dependent claims.

In the invention, a fluid-working machine has one or a plurality of working chambers of cyclically varying volume. Each chamber is independently connected to a piston actuator which is capable of moving an intake or exhaust valve in an internal combustion engine. The crankshaft of the fluid-working machine is driven at the same speed as the engine, and each working chamber is linked to the low-pressure manifold by a venting valve, the venting valve being normally open but electromagnetically closable by a signal from an electronic sequencing means which operates in timed relationship to the engine crankshaft phase.

Preferably the electronic sequencing means can operate in two modes, the first of which is normal timed operation, whereby the valves open and shut at optimal times during the engine cycle, the second being an idle mode where the sequencing means does not issue a signal to operate the poppet valve and so leaves it open throughout the engine cycle such that the intake and exhaust valves do not operate (and the engine cylinder does not admit or expel any working fluid) and where the fuel injector operation is suppressed.

Preferably, the electronic sequencing can change between operation modes on a rotation-by-rotation basis such that an idle stroke can immediately follow an active one and vice versa.

Preferably the electronic sequencing means can choose the time averaged ratio of idle to enabled cylinders according to the demanded power level such that the remaining enabled ones are used to produce more work and are, therefore, more efficient.

Preferably the electronic sequencing means can choose the sequence of idle cylinders to reduce engine torque pulsation using a "look ahead" algorithm which forecasts the future torque of previously enabled cylinders during the coming revolutions of the engine.

Preferably the electronic sequencing means can restart the four-cycle sequence for each cylinder at the beginning of each new revolution, if the previous revolution has been an idle mode, and thereby reduce the normal delay in achieving a power stroke such that torque control bandwidth is significantly improved.

Preferably the engine valve timing and duration can be adjusted to optimise engine efficiency and reduce emissions through a combination of varying both the phase relationship between the fluid-working machine and the engine and through the change of timing of the sequencing means of the electromagnetic valve.

For example, the electronic sequencing means can receive a signal representing a desired mechanical energy for a subsequent power stroke of the internal combustion engine, determines a lift time and an open duration for the intake valve which will admit an amount of air and fuel generating essentially said desired mechanical energy and actuates the corresponding venting valve to open the intake valve at that lift time and for that duration.

Moreover, the electronic sequencing means can determines a lift time and an open duration for the exhaust valve which will minimise emissions and maximise engine power and actuates the corresponding venting valve to open the exhaust valve at that lift time and for that duration.

BRIEF DESCRIPTION OF THE DRAWINGS

A particular embodiment of the invention will now be described, by way of example only, with reference to the accompanying drawings, in which.

DETAILED DESCRIPTION OF PARTICULAR EMBODIMENT

Figure 1:
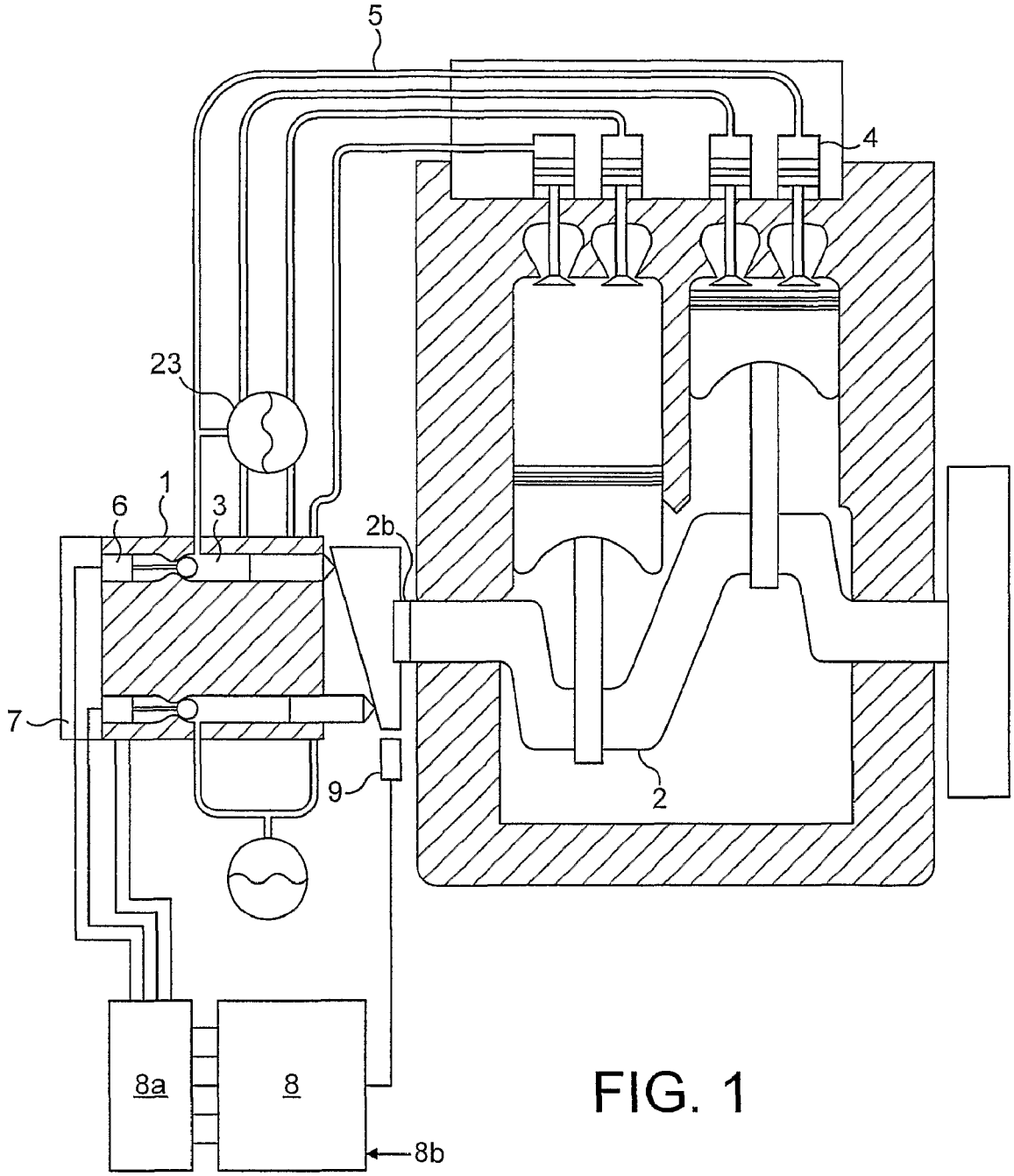
FIG. 1 shows a schematic layout of the valve actuation system.

The complete system is shown in FIG. 1. A multi-piston hydraulic machine 1 with two pistons per engine cylinder is phase-locked to the crankshaft 2 of an internal combustion engine and driven thereby at the same speed. The machine 1 resembles the pump described in EP-B-361927, but the one-way valve of that known pump communicating with the high-pressure gallery in each cylinder is removed, so that the pumping cylinder 3 directly communicates with a valve actuator 4 via a pipe 5. An electromagnetically controlled poppet valve 6 between a low-pressure manifold 7 and the cylinder 3 is used to regulate the actuation timing. A micro-controller 8 has, as an input, a once per revolution trigger 9 on the crankshaft, to give phase information, while its outputs, via power FETs 8*a* control the electromagnetic valves 6 in the multi-piston hydraulic machine in order to manage engine performance relative to a demand signal 8*b*.

Figure 2:
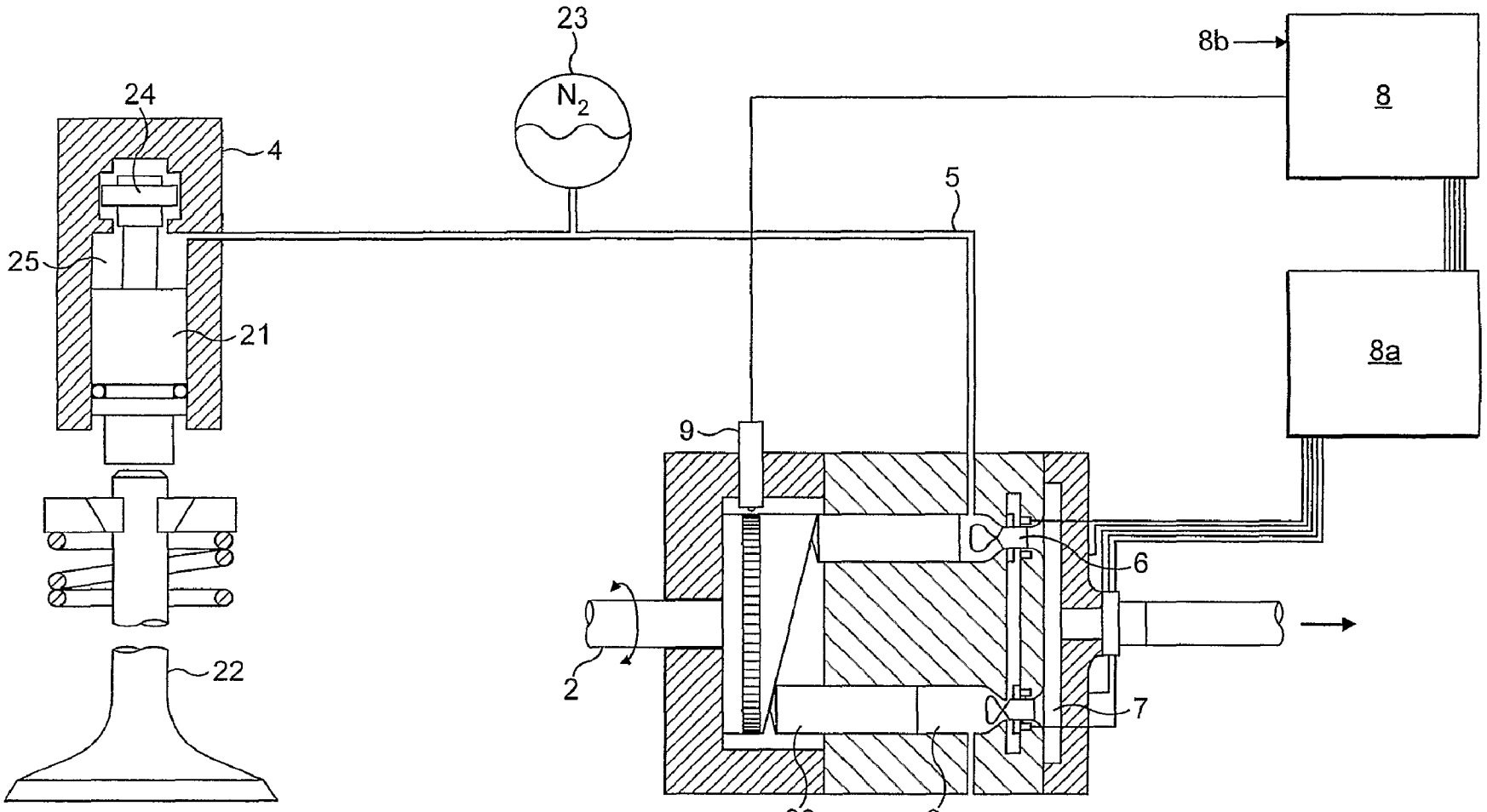
FIG. 2 is schematic sectional view of the fluid-working machine and the valve actuator, the latter shown larger than scale.

FIG. 2 shows a schematic cross section of the pump or fluid-working machine 1 and the valve actuator 4. In normal operation each pumping piston 20 begins its upward stroke from BDC, with the electromagnetically operated valve 6 latched open, such that initially the displaced fluid returns to the low-pressure tank 7. At the appropriate moment the poppet valve is closed by the system controller 8 such that the rising piston 20 now displaces the fluid into the cylinder 25 of actuator 4 and operates the engine valve 22 to push it open. Because the pump displacement will be greater than the volume of the actuator, the actuator will reach the end of its travel before the end of the pumping stroke and the remaining fluid will be displaced into an accumulator 23, which could be a liquid, gas or mechanical spring. After the piston passes the TDC position, the accumulator first discharges while the actuator is held at its end of stroke position, then the valve follows the piston motion back to the closed position. Once the actuator is at the end-of-stroke position, the pressure in the cylinder collapses as the piston continues to move toward BDC. The electromagnetic poppet valve 6 is now pulled open by the pressure differential between cylinder 3 and tank 7 and the cycle can begin once again. During this final phase any leakage or expansion can be made up to maintain a fully filled volume in the pump/actuator circuit.

Because the engine valve actuation occurs part way into the sinusoidal stroke, the transit time is very short in both the opening and closing directions.

Valve striking noise is limited through the use of fluid cushion dampers 24 within the actuator cylinder 25 at both ends of the actuator piston 21 stroke.

The valve timing and duration can be adjusted in two ways. The phase between the engine and the fluid-working machine crankshafts can be varied by a limited angle rotary actuator 2*b* in the coupling means or, if the machines are linked by a belt or chain, an idler on an arm, or eccentric, acting on the belt or chain between the sprockets, on its driven side, can be moved to deflect the path of the belt and so change the active length between the two machines. The timing of the closing of the electromagnetic valve 6 effectively selects the starting time of the valve opening, with the position of this valve actuation on the underlying piston motion determining the valve opening duration. Thus by combining the two adjustments the machine phase and the electromagnetic valve timing, both the starting time of the valve and its opening duration can be controlled.

In a four-stroke engine each valve is actuated for only one stroke in four, or every other revolution. The engine induction valve can be left closed, and the cylinder can be left idle without pumping loss, by leaving the electromagnetic valve open through the pumping stroke of the cylinder such that the actuator is never pressurised during alternate revolutions.

To efficiently regulate power output of the engine, the entire two-revolution cycle can be disabled or idled by keeping the intake and exhaust valves shut through both revolutions. The valve control strategy works in conjunction with a fuel injector which also cuts fuel supply to the idle cylinder. Preferably, the electronic sequencing can change between operation modes on a rotation-by-rotation basis such that an idle stroke can immediately follow an active one and vice versa.

Figure 3:
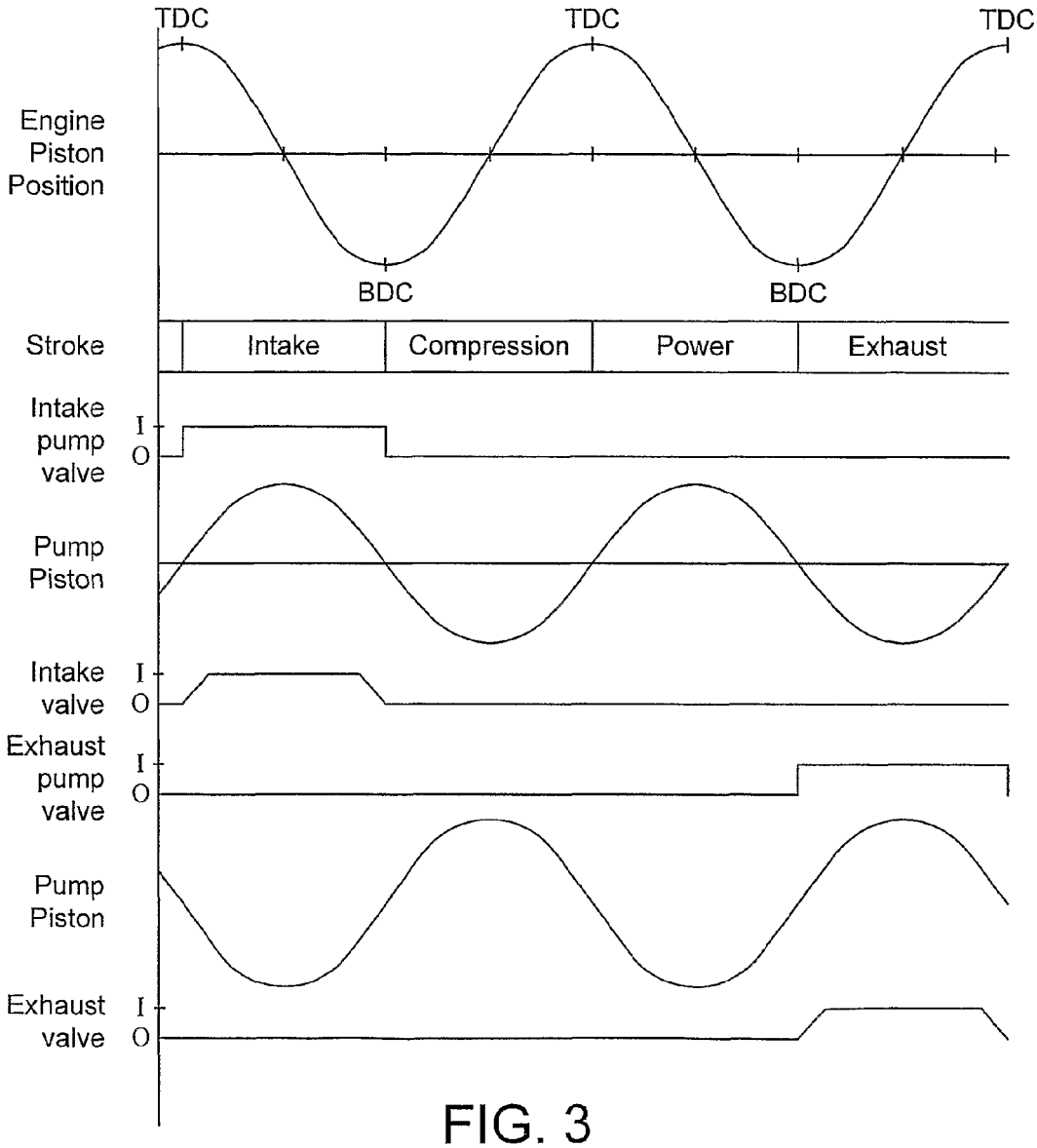
FIG. 3 is a timing diagram of the engine operation with the valve event timing of the fluid-working machine.

FIG. 3 shows the valve events of a four-stroke cycle relative to the engine piston motion 30. The second trace 31 denotes the engine stroke, the third 32 shows the idealised position of the intake valve and also the position of the electromagnetic control valve 6 in the fluid working machine which corresponds with the intake valve. The fourth trace 33 shows the position of the fluid-working machine piston, approximately 90 degrees ahead of the engine piston in phase. The fifth trace shows the resulting intake valve motion. The valve is initially closed, and then opens, following a trajectory 34 with the same slope as the sinusoid of the piston motion at that instant (if the valve actuator and fluid working machine pistons are of the same diameter), finally the actuator strikes the end-stop and the valve remains open 35 at its largest extent. The closure of the valve is a reversal of the same process. The exhaust valve operation is similarly demonstrated in the remaining traces.

The idling process can occur on a stroke-by-stroke basis so that the cylinder enabling philosophy, described in EP-B-361927, can be employed to an internal combustion engine. This allows the reduced number of enabled cylinders to work at much higher brake mean effective pressure, and efficiency, than would a full complement of partly-loaded cylinders. The electronic control of the valves, spark and the fuel injection allows the conventional four-stroke cycle to be interrupted and restarted on a rotation-by-rotation basis, thus effectively doubling the bandwidth of the engine speed control. This technique allows the torque pulses, created by disabling fixed banks of cylinders, to be significantly reduced. The controller can use a look-ahead algorithm on the currently enabled cylinders to forecast coming torque pulsations and so choose to enable cylinders which will act to oppose and reduce the crankshaft torsional pulse amplitude.

The independent claim 1 includes the word "comprising", from which it should be understood that the control arrangement may consist exclusively of the components mentioned but may include further components.

The invention claimed is:

1. A valvetrain control arrangement comprising a fluid-working machine having at least one working chamber of cyclically varying volume and a low pressure manifold, the or each working chamber being connected to a piston actuator which is capable of moving an intake or exhaust valve in an internal combustion engine; said fluid-working machine having a crankshaft driven by the engine, the or each working chamber being linked to the low-pressure manifold by a venting valve, the venting valve being electromagnetically operable by a signal from an electronic sequencing element which operates in timed relationship to the phase of the engine crankshaft, wherein the engine has a speed and the said crankshaft of the fluid-working machine has a speed and the said speed of the engine and the said speed of the crankshaft of the fluid-working machine are the same.

2. An arrangement according to claim 1, wherein the venting valve is normally open and is closable by said signal.

3. An arrangement according to claim 1, wherein the fluid-working machine has a plurality of working chambers, each independently connected to a piston actuator.

4. An arrangement according to claim 1, wherein the working chamber or at least one of the working chambers of the fluid-working machine is connected to more than one piston actuator, for controlling an internal combustion engine in which the or each cylinder has more than one intake valve or more than one exhaust valve.

5. An arrangement according to claim 1, wherein the or each working chamber of the fluid-working machine is connectable by a selector at different times to different piston actuators for moving respective valves of the engine.

6. An arrangement according to claim 1, wherein the electronic sequencing element is operable in a normal timed operation mode, wherein the intake and/or exhaust valves open and shut at optimal times during the engine cycle, as well as an idle mode wherein the sequencing element does not issue a signal to operate the venting valve so that the piston actuator does not operate the intake or exhaust valve which it is capable of moving, the arrangement including an element operable to suppress fuel injection in the idle mode.

7. An arrangement according to claim 6, wherein the electronic sequencing can change between said normal and idle modes after a turn of the crankshaft such that an idle stroke can immediately follow an active one and vice versa.

8. An arrangement according to claim 6, for controlling an internal combustion engine having a plurality of cylinders, wherein the electronic sequencing element is operable to choose a time-averaged ratio of idle to enabled cylinders such that the enabled cylinders are used to produce more work at higher efficiency than operating all of the cylinders at a lower power.

9. An arrangement according to claim 8, wherein the electronic sequencing element can choose the sequence of idle cylinders to reduce engine torque pulsation using a "look ahead" algorithm which forecasts the future torque of previously enabled cylinders during the coming revolutions of the engine.

10. An arrangement according to claim 1, wherein the electromagnetically operable venting valve(s) is/are located adjacent the corresponding piston actuator(s), and the or each working chamber has an additional passive check valve for fluid admission.

11. An arrangement according to claim 1, including a non-circular cam for driving the working chambers of the fluid-working machine in a motion profile which is not sinusoidal.

12. An arrangement according to claim 1, including a connector for connecting said crankshaft of the fluid-working machine to a crankshaft of the internal combustion engine at different angular positions to alter the phase of the fluid-working machine relative to that of the engine crankshaft.

13. An arrangement according to claim 1, wherein the displacement of the working chamber is greater than the volume of the piston actuator.

14. An arrangement according to claim 1, wherein the venting valve regulates whether displaced fluid is returned to the low-pressure manifold or displaced into the actuator cylinder.

15. An arrangement according to claim 1, wherein the venting valve is electromagnetically closable to displace fluid from the working chamber into the actuator cylinder.

16. An arrangement according to claim 1, wherein the timing of the closure of the venting valve selects the timing of the opening of the intake or exhaust valve.

17. An arrangement according to claim 1, wherein the electronic sequencing element determines the open duration for which the valve is open.

18. An arrangement according to claim 1, wherein a valve striking noise of the intake or exhaust valve is limited by fluid dampers.

19. An arrangement according to claim 1, wherein the or each working chamber communicate directly with the piston actuator.

* * * * *